US007194925B2

(12) United States Patent
Kajino et al.

(10) Patent No.: US 7,194,925 B2
(45) Date of Patent: Mar. 27, 2007

(54) STARTER

(75) Inventors: Sadayoshi Kajino, Nagoya (JP); Kei Shibayama, Nagoya (JP); Syuichi Aoki, Oura-gun (JP)

(73) Assignees: Denso Corporation, Kariya (JP); Sawafuji Electric Co., Ltd., Tokyo (JP)

( * ) Notice: Subject to any disclaimer, the term of this patent is extended or adjusted under 35 U.S.C. 154(b) by 511 days.

(21) Appl. No.: 10/623,494

(22) Filed: Jul. 22, 2003

(65) Prior Publication Data

US 2004/0123686 A1 Jul. 1, 2004

(30) Foreign Application Priority Data

Jul. 29, 2002 (JP) ..... 2002-219656

(51) Int. Cl.
*F02N 15/02* (2006.01)
*F02N 15/04* (2006.01)
*F02N 15/06* (2006.01)

(52) U.S. Cl. ..... 74/7 E; 475/290

(58) Field of Classification Search ..... 74/7 A–7 E, 74/6, 7 R; 123/179.1; 290/36 R, 38 R, 290/46; 475/290, 317
See application file for complete search history.

(56) References Cited

U.S. PATENT DOCUMENTS 2,679,170 A * 5/1954 Prittie ..... 475/159
4,635,489 A * 1/1987 Imamura et al. ..... 74/7 E
5,323,663 A * 6/1994 Ohgi et al. ..... 74/7 E
5,905,309 A * 5/1999 Ohmi et al. ..... 290/36 R
5,905,310 A * 5/1999 Nagao ..... 290/46
6,076,413 A * 6/2000 Verot et al. ..... 74/7 E
6,142,028 A * 11/2000 Soh ..... 74/7 C
6,239,503 B1 * 5/2001 Ikeda et al. ..... 290/38 R
6,409,622 B1 * 6/2002 Bolz et al. ..... 475/5
6,619,145 B2 * 9/2003 Hosoya ..... 74/7 E
6,664,652 B2 * 12/2003 Chane-Waye ..... 290/38 R
6,782,770 B2 * 8/2004 Saito et al. ..... 74/7 E
7,018,314 B2 * 3/2006 Hasegawa et al. ..... 475/5

FOREIGN PATENT DOCUMENTS

JP U-62-71374 5/1987
JP A-62-247175 10/1987
JP A-4-159455 6/1992
JP A 10-9104 1/1998
JP A-10-299628 11/1998
JP A 11-117946 4/1999

* cited by examiner

*Primary Examiner*—Richard Ridley
*Assistant Examiner*—James Pilkington
(74) *Attorney, Agent, or Firm*—Oliff & Berridge, PLC

(57) ABSTRACT

A shock absorbing device 8 includes a transmitting section 81, first friction plates 82, second friction plates 83, and a dish spring 84. The transmitting section 81 is engaged with the inner cylindrical portion of the second friction plates 83 and also engaged with an outer cylindrical surface of an internal gear 42. The first friction plates 82 are stationarily fixed to an end portion 102*a* of a central housing. The second friction plates 83 are brought into frictional engagement with the first friction plates 82 under a resilient force applied from the dish spring 84. The first friction plates 82 and the second friction plates 83 are alternately laminated.

4 Claims, 7 Drawing Sheets

STARTER

BACKGROUND OF THE INVENTION

This invention relates to a stator equipped with a planetary reduction gear device for transmitting reduced rotation of a starter motor to an output shaft, and more particularly to a shock absorbing device employed in this stator.

Japanese Patent Application Laid-open No. 11-117946 (1999) discloses a conventional shock absorbing device for a starter which includes a rotary disk engaging with an internal gear of a planetary reduction gear device and rotating when a predetermined torque is applied, a stationary disk brought into frictional engagement with this rotary disk, and a dish spring pressing the stationary disk toward the rotary disk. When an impact force acts between a pinion gear and a ring gear, an excessive torque is applied to the rotary disk via the internal gear. The rotary disk rotates in response to this excessive torque. The internal gear, engaging with the rotary disk, also rotates to absorb the transmitted shock.

However, according to the above-described conventional shock absorbing device for a starter, only one rotary disk and the stationary disk constitute the shock absorbing device. The torque transmittable through this shock absorbing device is small. For example, if this conventional shock absorbing device is incorporated into a starter employed for a diesel engine, the shock absorbing device will be subjected to a very high torque and the rotary disk will be forcibly rotated. Thus, due to undesirable rotation of the rotary disk, a torque actually transmittable through this shock absorbing device is small.

SUMMARY OF THE INVENTION

In view of the above-described problems, the present invention has an object to provide a starter capable of transmitting a large torque.

In order to accomplish the above and other related objects, the present invention provides a starter including a starter motor driven in response to supply of electric power for generating a rotational force transmitted to an armature. A planetary reduction gear device, including a sun gear provided on a rotary shaft of the armature, planetary gears meshing with the sun gear, and an internal gear meshing with the planetary gears, reduces the rotational speed of the armature. An output shaft is connected to the armature via the planetary reduction gear device for outputting the reduced rotation of the armature. A pinion gear, provided on the output shaft, selectively meshes with a ring gear of an engine. A shock absorbing device includes a plurality of first friction plates provided stationarily and a plurality of second friction plates receiving a torque transmitted from the internal gear. The first and second friction plates are laminated with each other so as to be brought into frictional engagement when the first and second friction plates are pressed by pressing means, thereby obtaining a predetermined frictional torque.

According to this arrangement, a plurality of first friction plates and a plurality of second friction plates are laminated with each other. The torque transmittable through the shock absorbing device is large. Thus, it becomes possible to provide a starter capable of transmitting a large torque. The size of the shock absorbing device is compact in the direction normal to a lamination direction of the first and second friction plates. Accordingly, the starter becomes compact and is easily installable into an engine. Furthermore, while the shock absorbing device can transmit a large torque, the constituent parts of the planetary reduction gear device can assure sufficient strength even they are downsized. The overall weight of the shock absorbing device is small.

According to an embodiment of the present invention, it is preferable that the shock absorbing device includes a transmitting section interposed between the second friction plates and the internal gear.

The transmitting section supports the second friction plates. The torque transmitted from the internal gear can be received by the second friction plates via the transmitting section.

According to the embodiment of the present invention, it is preferable that the transmitting section includes a first cylindrical portion engaged with an outer cylindrical surface of the internal gear and a second cylindrical portion engaged with an inner cylindrical portion of the second friction plates, wherein the diameter of the second cylindrical portion is smaller than the diameter of the first cylindrical portion.

The second friction plates are located at the radially outside of the second cylindrical portion, while the internal gear is located at the radially inside of the first cylindrical portion. As the diameter of the second cylindrical portion is smaller than the diameter of the first cylindrical portion, it becomes possible to reduce the difference between the second friction plates and the internal gear in the radial direction. Thus, the radial size of the shock absorbing device can be reduced.

According to the embodiment of the present invention, it is preferable that the shock absorbing device is positioned next to the internal gear.

Providing the shock absorbing device next to the internal gear makes it easy to transmit the torque from the internal gear to the second friction plates. Furthermore, the length in the laminating direction of the first and second friction plates can be shortened.

According to the embodiment of the present invention, it is preferable that one end of the output shaft is configured into a flange portion for supporting the planetary reduction gear device, and the shock absorbing device is disposed in a radially extending space defined between the flange portion and a housing accommodating the flange portion.

Utilizing the radially outer side of the flange for accommodating the shock absorbing device makes it possible to reduce the axial size of the starter.

According to the embodiment of the present invention, it is preferable that the first friction plates are engaged with an engaging portion of the housing, and the engaging portion of the housing extends in a direction along which the first and second friction plates are laminated.

In the installation of the shock absorbing device, the first friction plates can be smoothly engaged with the engaging portion of the housing.

According to the embodiment of the present invention, it is preferable that the second cylindrical portion has a caulking portion for supporting the pressing means.

With this arrangement, the pressing means can be supported by deforming the calking portion so as to set a predetermined torque for the first and second friction plates. Providing the caulking portion makes it possible to integrate the shock absorbing device as a unit.

BRIEF DESCRIPTION OF THE DRAWINGS

The above and other objects, features and advantages of the present invention will become more apparent from the following detailed description which is to be read in conjunction with the accompanying drawings, in which.

DESCRIPTION OF THE PREFERRED EMBODIMENTS

Preferred embodiments of the present invention will be explained hereinafter with reference to attached drawings.

Figure 1:
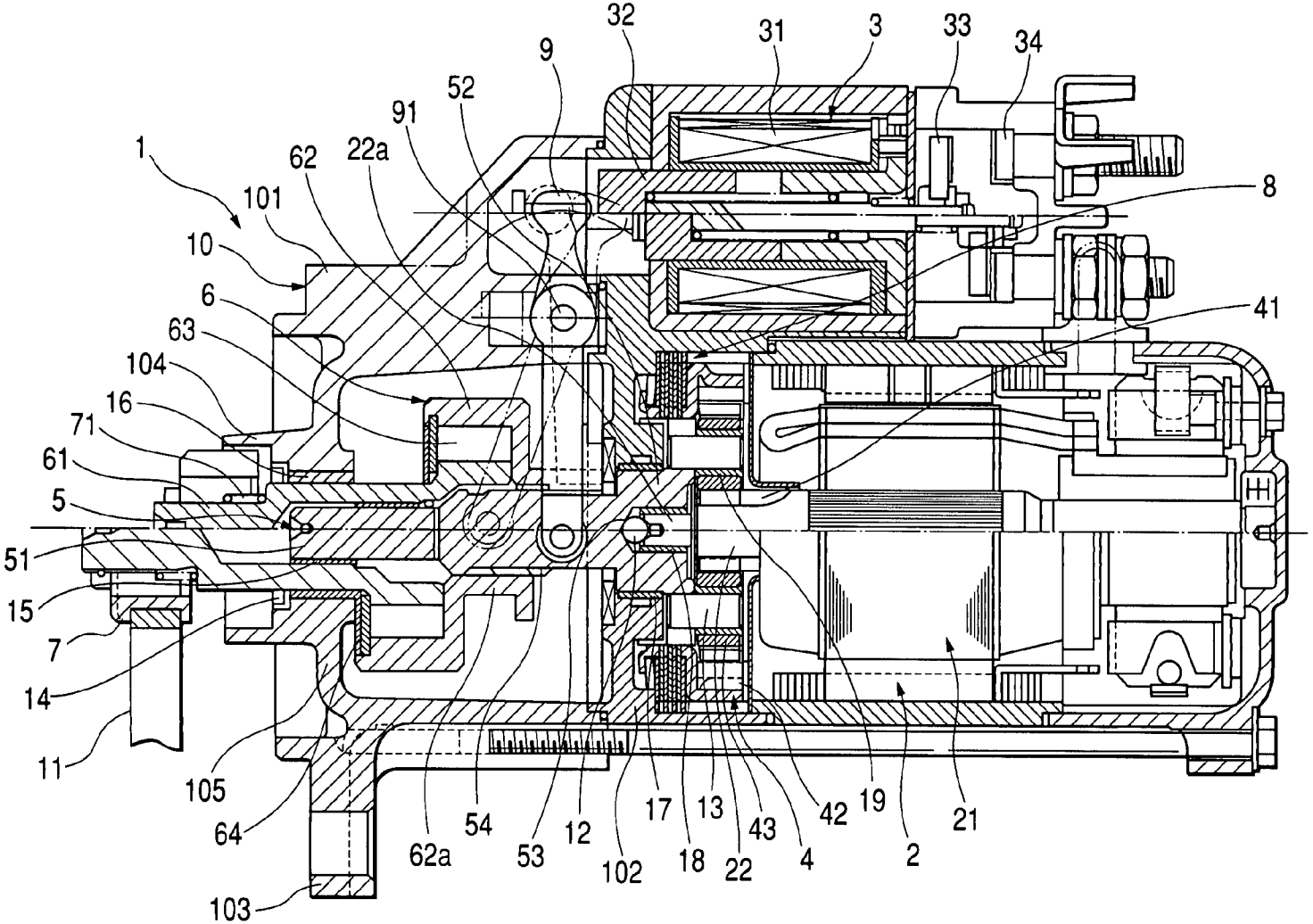
FIG. 1 is a cross-sectional view showing an overall arrangement of a starter in accordance with a preferred embodiment of the present invention.

FIG. 1 shows a starter 1 in accordance with a preferred embodiment of the present invention. A starter motor 2 generates a rotational force. A magnet switch 3 has a function of ON/OFF controlling power current supplied to the starter motor 2. A planetary reduction gear device 4 decelerates the rotation of the starter motor 2 and transmits the decelerated rotation of the starter motor 2 to an output shaft 5. A one-way clutch 6, disposed on the output shaft 5, transmits the rotation of the output shaft 5 to a pinion gear 7. A shock absorbing device 8 absorbs an excessive torque applied to the driving mechanism of the starter 1.

The starter motor 2 is a well-known direct-current motor. When the magnetic switch 3 closes a power supply circuit of the starter motor 2, electric power is supplied from a battery (not shown) to the starter motor 2 and an armature 21 generates a rotational force.

The magnet switch 3 includes an exiting coil 31 generating magnetic flux when electric power is supplied from the battery in response to turning on of an ignition switch (not shown). A plunger 32 is placed in an axial bore of the exiting coil 31. The plunger 32 is slidable along an inner cylindrical surface of the exciting coil 31. A movable contact 33 is attached on the end of the plunger 32. When the plunger 32 is pulled by the magnetic force generated by the exciting coil 31, the movable contact 33 attached on the end of the plunger 32 is brought into contact with a stationary contact 34. Bringing these contacts 33 and 34 into the connected condition closes the power supply circuit of the starter motor 2.

Figure 7:
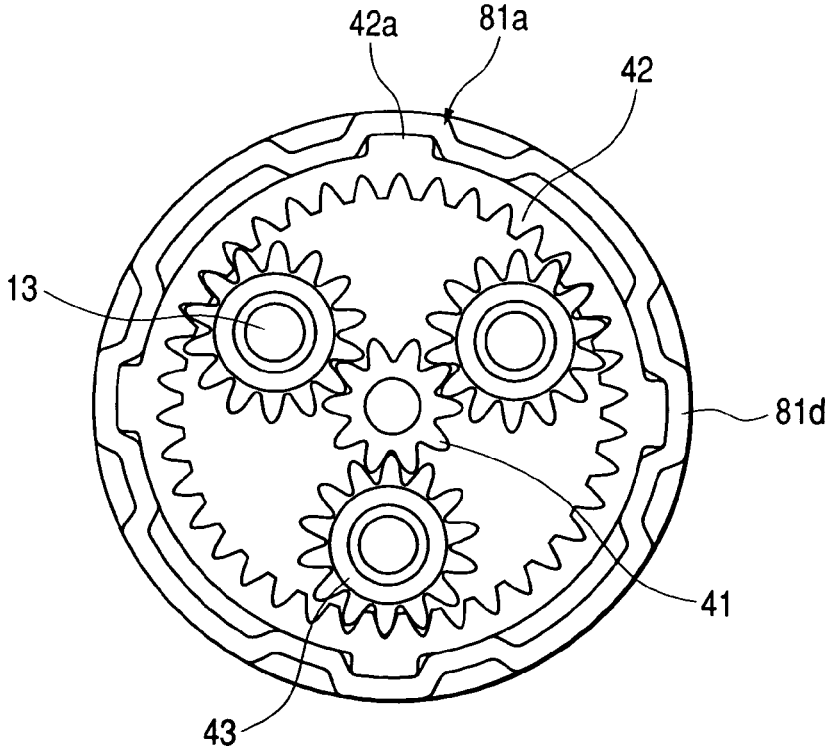
FIG. 7 is a plan view showing the planetary reduction gear device and part of the shock absorbing device in accordance with the preferred embodiment of the present invention.

The planetary reduction gear device 4, as shown in FIG. 7, includes a sun gear 41 attached to an outer cylindrical surface of one end of an armature shaft 22 of the starter motor 2. An internal gear 42, being configured into a ring shape, is disposed coaxially with the sun gear 41 and spaced radially outer side about the sun gear 41. A plurality of, e.g., three, planetary gears 43 are interposed between the sun gear 41 and the internal gear 42 so as to mesh with both the sun gear 41 and the internal gear 42. When the armature 21 is rotating, the sun gear 41 transmits the rotation of the armature 21 to the planetary gears 43. Each planetary gear 43 not only causes autorotation but also causes revolution about the sun gear 41. The revolution of the planetary gears 43 is transmitted as a rotational power to the output shaft 5. The internal gear 42 has a plurality of engaging projections 42*a* formed at equal angular intervals along the outer periphery thereof.

The output shaft 5 consists of a center shaft 51 and a flange portion 52.

Figure 2:
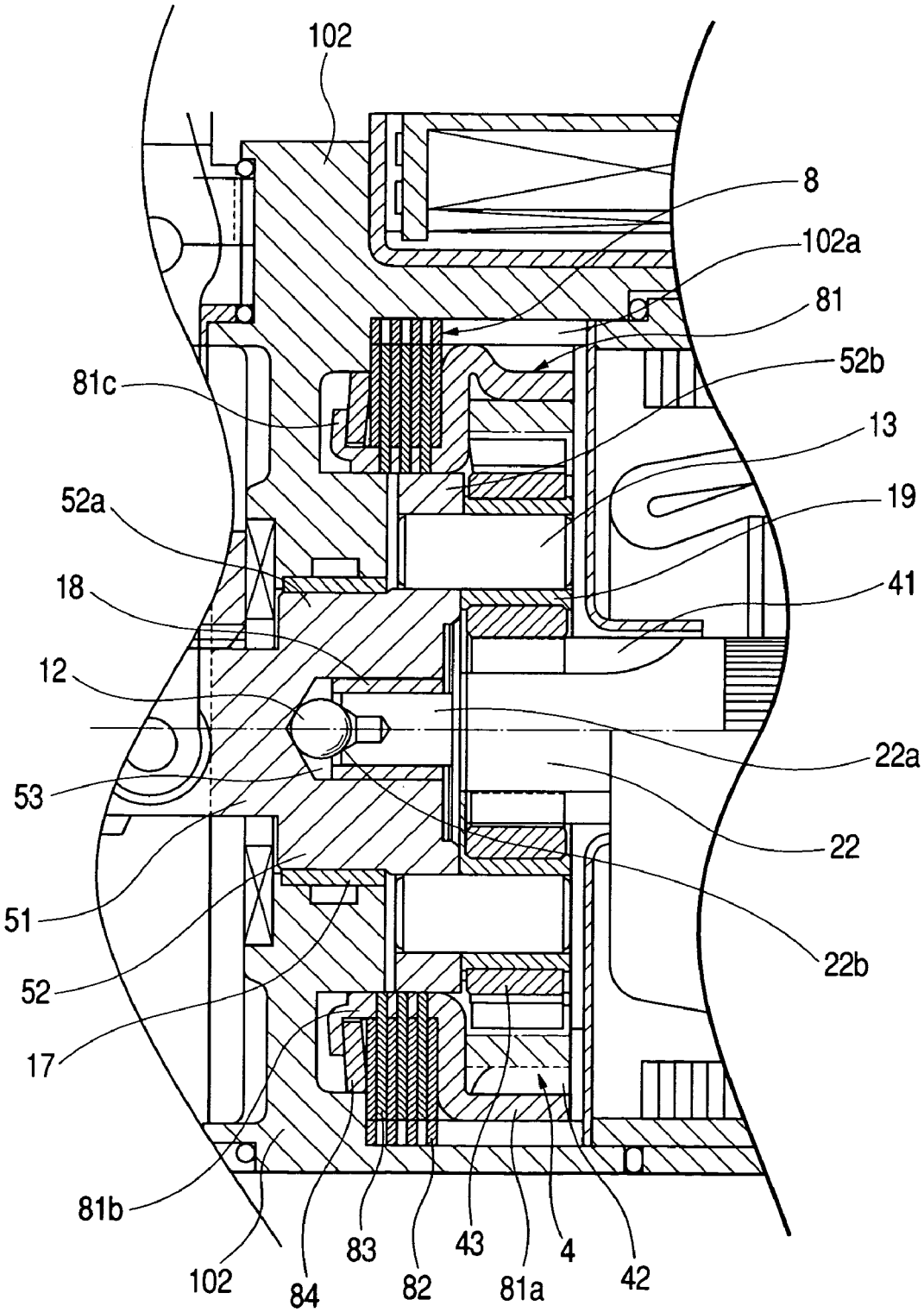
FIG. 2 is an enlarged cross-sectional view showing a planetary reduction gear device and a shock absorbing device incorporated in the starter shown in FIG. 1.

The center shaft 51 is disposed coaxially with the armature shaft 22. The rear end of the center shaft 51 is configured into an accommodation portion 53 recessed in the axial direction. The accommodation portion 53 receives a front end shaft portion 22*a* of the armature shaft 22 via a bearing 18. As shown in FIG. 2, a conical recessed portion 22*b* is formed at the center of the front end shaft portion 22*a* of the armature shaft 22. A ball 12 is disposed between a bottom surface of the accommodation portion 53 and the recessed portion 22*b* of the armature shaft 22. The conical surface of the recessed portion 22*b* has a function of positioning the ball 12 on the axis of the center shaft 51 (i.e., on the armature shaft 22). The ball 12 receives a thrust force of the output shaft 5.

The flange portion 52 is integrally formed with the center shaft 51 at an axial end closer to the planetary reduction gear device 4. The flange portion 52 consists of a cylindrical portion 52*a* and a circular outer peripheral portion 52*b*. The flange portion 52 is configured into a cylindrical shape with the diameter of the circular outer peripheral portion 52*b* being enlarged compared with the diameter of the cylindrical portion 52*a*. The cylindrical portion 52*a* is integrally formed with the center shaft 51. The outer peripheral portion 52*b* has a plurality of (e.g., three) holes each receiving a carrier pin 13. Each carrier pin 13 rotatably supports the planetary gear 43 via a bearing 19.

The one-way clutch 6 includes an inner member 61, an outer member 62, rollers 63, and a clutch cover (not shown). The inner member 61 is coupled around the outer cylindrical surface of the center shaft 51 of the output shaft 5 via a bearing 15. The outer member 62 is disposed coaxially with the outer cylindrical surface of the inner member 61. The outer member 62 has a plurality of wedged cam chambers (not shown) formed on an inner cylindrical surface thereof. The outer member 62 is integrally formed with a spline sleeve portion 62*a* coupled with the output shaft 5 via a helical spline 54. The spline sleeve portion 62*a* has an outer surface with which one end of a lever 9 is engaged. Each roller 63 is accommodated in the cam chamber and is resiliently urged by a spring (not shown) toward a narrowed side of the cam chamber. A plate 64 regulates the shift movement of the roller 63. The clutch cover securely covers the outer cylindrical surface of the outer member 62 as well as the outer surface of the plate 64, thereby fixedly positioning the outer member 62 and the plate 64.

The pinion gear 7 is provided at the front end of the inner member 61 and is shiftable relative to the inner member 61 in the axial direction. A spring 71, extending in the axial direction, interposes between the pinion gear 7 and the inner member 61.

The shock absorbing device 8, as shown in FIG. 2, includes a transmitting section 81, first friction plates 82, second friction plates 83, and a dish spring 84. The shock absorbing device 8 is located at the radially outer side of the carrier pins 13 and is disposed in an inside space defined by an inner wall of a central housing 102 and an outer cylindrical surface of the planetary reduction gear device 4. The shock absorbing device 8 is provided at a position neighboring an axial end side of the internal gear 42 closer to the pinion gear 7.

The transmitting section 81 consists of a first cylindrical portion 81*a*, a second cylindrical portion 81*b*, and a caulking portion 81*c*. The outer diameter of the first cylindrical portion 81*a* is larger than that of the second cylindrical portion 81*b*.

The first cylindrical portion 81*a*, as shown in FIG. 7, is located along the outer cylindrical portion of the internal gear 42. The first cylindrical portion 81*a* has first engaging portions 81*d* provided at predetermined angular intervals in the circumferential direction so as to meet with the engaging projections 42*a* of the internal gear 42. The first engaging portions 81*d* are formed by recessing both circumferential ends thereof. Thus, the first engaging portions 81*d* engage with the engaging projections 42*a* of the internal gear 42.

Figure 3:
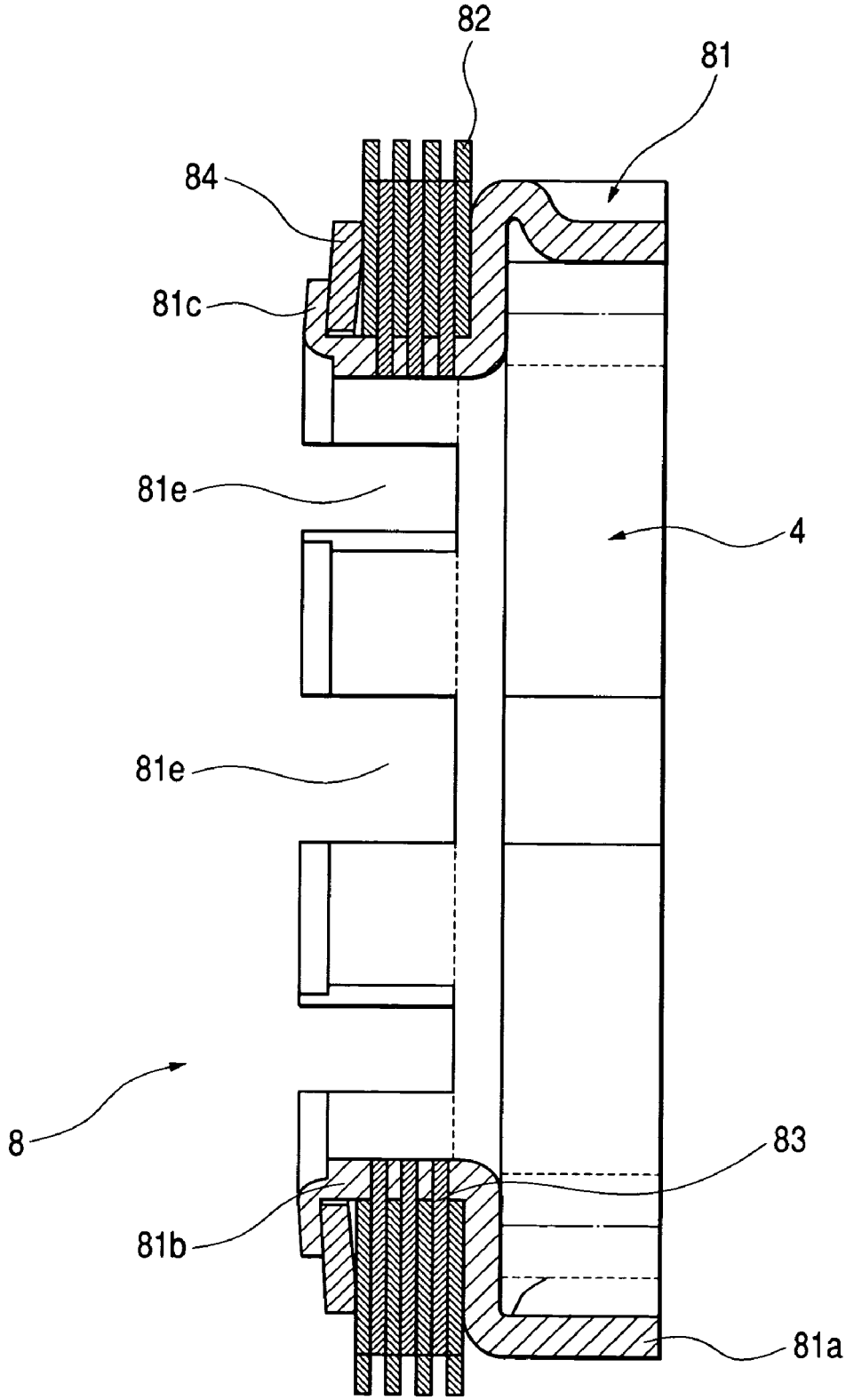
FIG. 3 is an enlarged cross-sectional view showing the shock absorbing device in accordance with the preferred embodiment of the present invention.

The second cylindrical portion 81*b* is positioned along the inner cylindrical portion of the first friction plates 82, the second friction plates 83, and the dish spring 84. The second cylindrical portion 81*b*, as shown in FIG. 3, has second engaging portions 81*e* being configured into cutout shape at predetermined angular intervals in the circumferential direction so as to meet with second projections 83*a* of the second friction plates 83.

The caulking portion 81*c* is located at the front end of the transmitting section 81. The caulking portion 81*c* supports the dish spring 84 in the axial direction.

Figure 4:
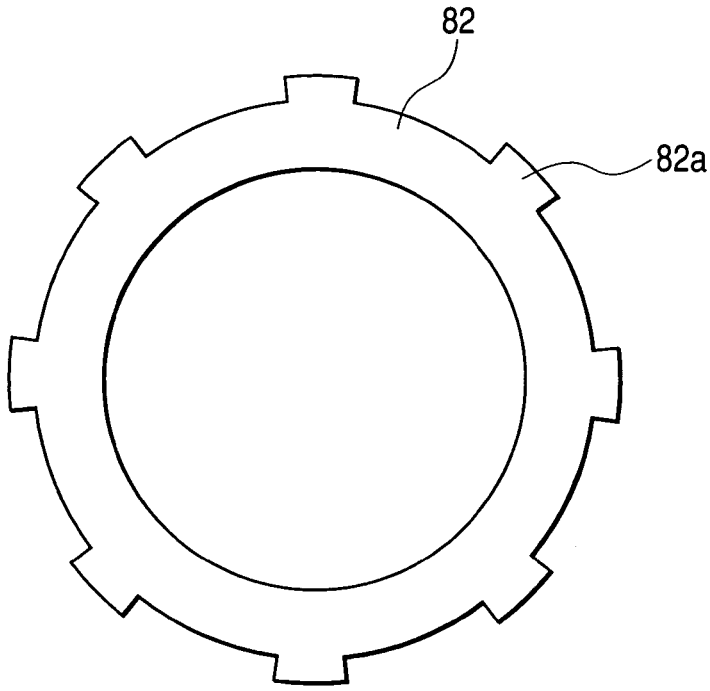
FIG. 4 is a plan view showing a first friction plate consisting part of the shock absorbing device in accordance with the preferred embodiment of the present invention.

Each of the first friction plates 82, as shown in FIG. 4, is configured into a flat circular ring shape with a plurality of first projections 82*a* protruding radially outward. The first projections 82*a* are located at equal angular intervals in the circumferential direction along the outer periphery of the first friction plate 82. As shown in FIG. 2, the first projections 82*a* engage with an end portion 102*a* of the central housing 102. A lubricating groove (not shown) is formed on an axial end surface of the first friction plate 82.

Figure 5:
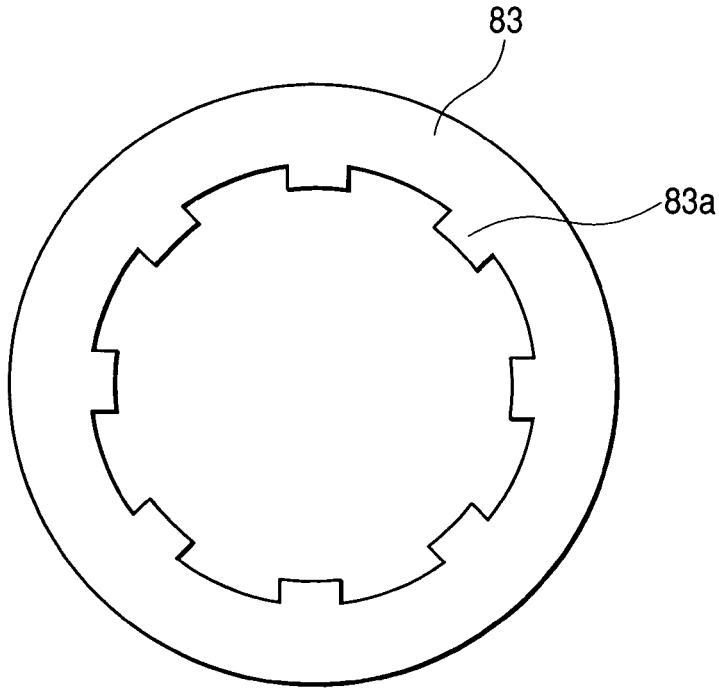
FIG. 5 is a plan view showing a second friction plate consisting part of the shock absorbing device in accordance with the preferred embodiment of the present invention.
Figure 6:
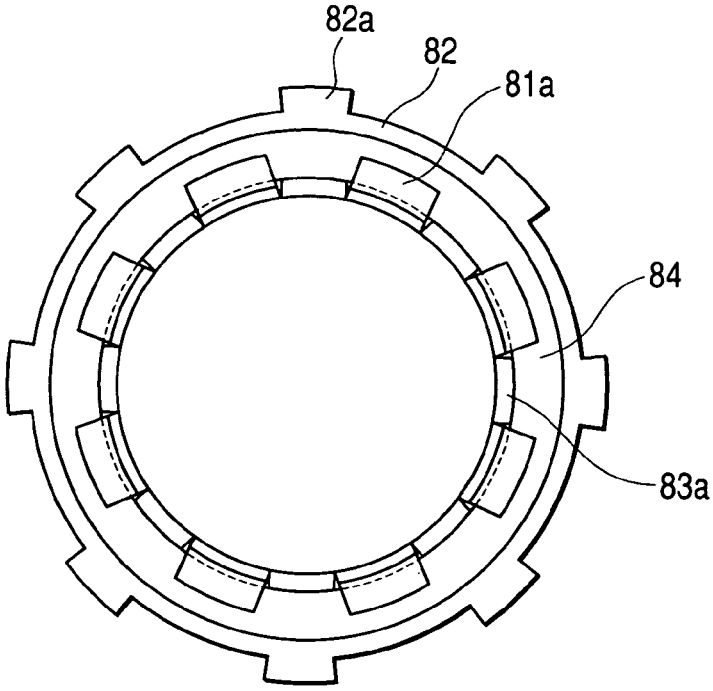
FIG. 6 is a side view showing the shock absorbing device shown in FIG. 3, seen from the direction of an axis of the shock absorbing device.

Each of the second friction plates 83, as shown in FIG. 5, is configured into a flat circular ring shape with a plurality of second projections 83*a* protruding radially inward. The second projections 83*a* are located at equal angular intervals in the circumferential direction along the inner periphery of the second friction plate 83. As shown in FIG. 3, the second projections 83*a* engage with the second engaging portions 81*e* of the second cylindrical portion 81*b*. The circumferential positions of respective first projections 82*a* are identical with those of respective second projections 83*a*.

Furthermore, as shown in FIG. 3, the number of the first friction plates 82 is four and the number of the second friction plates 83 is three. The first friction plates 82 and the second friction plates 83 are alternately laminated or stacked in the axial direction. The first friction plate 82 positioned at the rear axial end is brought into contact with a front end surface of the transmitting section 81. The first friction plate 82 positioned at the front axial end is brought into contact with a rear end of the dish spring 84.

The dish spring 84 serving as pressing means, as shown in FIG. 3, is supported at its front axial end by the caulking portion 81*c*. The rear axial end of the dish spring 84 is brought into contact with the foremost first friction plate 82. The dish spring 84 resiliently urges the first friction plates 82 and the second friction plates 83 in the axial direction. The dish spring 84 is fixed by deforming the caulking portion 81*c*. The caulking amount or depth of the caulking portion 81*c* is dependent on a required torque being determined beforehand.

The caulking portion 81*c* thus supports the first friction plates 82, the second friction plates 83, and the dish spring 84 as a unit (i.e., the shock absorbing device 8) at the radially outer side of the second cylindrical portion 81*b*.

The lever 9 has one end engaged with the outer cylindrical surface of the spline sleeve portion 62*a* of the one-way clutch 6. The other end of the lever 9 is connected to an axial front end of the plunger 32.

The housing 10, serving as an outer wall of the starter 1, consists of a front housing 101 and a central housing 102.

The front housing 101 has a flange 103 used when the starter 1 is installed to an engine. A nose portion 104, positioned at the front side of the flange 103, surrounds the outer cylindrical surface of the pinion gear 7. The front housing 101 has a holding portion 105 for holding a bearing 16. A seal member 14 is provided at an axial side of the bearing 16 closer to the pinion gear 7. The seal member 14 slidably contacts with the outer cylindrical surface of the inner member 61 of the one-way clutch 6. The seal member 14 is, for example, an oil seal and is offset from the bearing 16 in the axial direction. The seal member 14 is press-fitted into the holding portion 105 of the front housing 101. The front end of the front housing 101 supports the outer cylindrical surface of the inner member 61 via the bearing 16.

The central housing 102 is connected to the rear end of the front housing 101. The central housing 102 rotatably supports the cylindrical portion 52*a* of the flange portion 52 of the output shaft 5 via a bearing 17. The center shaft 51 of the output shaft 5 is supported by an inner cylindrical surface of the inner member 61 via a bearing 15 provided at the front end side. The end portion 102*a* of the central housing 102 is provided with a plurality of grooves (not shown) extending in the axial direction (i.e., in the laminating direction of the first friction plates 82 and the second friction plate 83). The circumferential positions of respective grooves correspond to the positions of the first projections 82*a* of the first friction plates 82 so that the first projections 82*a* can engage with these grooves.

The above-described starter operates in the following manner. The overall arrangement of the starter 1 shown in FIG. 1 is partly depicted into the upper half (showing a non-operated condition) and the lower half (showing an operated condition) with respect to respective axes of the plunger 32, the one-way clutch 6, and the pinion gear 7. The lever 9 depicted by a solid line corresponds to the non-operated condition of the starter 1. The lever 9 depicted by an alternate long and two short dashes line corresponds to the operated condition of the starter 1.

When the key switch is turned on, electric power is supplied to the exciting coil 31 of the magnet switch 3. The excite coil 31, generating the magnetic flux, pulls the plunger 32 in the axial direction. The lever 9 swings to a predetermined direction (i.e., the clockwise direction in FIG. 1) about its fulcrum 91. The lower end of the one-way clutch 6 is engaged with the spline sleeve portion 62*a* of the one-way clutch 6. Thus, in accordance with the swing movement of the lever 9, the spline sleeve portion 62*a* of the one-way clutch 6 slides forward along the helical spline 54 on the output shaft 5. The pinion gear 7 attached to the one-way clutch 6 shifts along the output shaft 5 toward the ring gear 11.

On the other hand, in accordance with the shift movement of the plunger 32, the movable contact 33 of the magnet switch 3 is brought into contact with the stationary contact 34. Electric power is supplied from the battery to the starter motor 2. The armature 21 generates a rotational force. The rotation of the armature 21 is reduced by the planetary reduction gear device 4 and is transmitted to the output shaft 5. Then, the rotation of the output shaft 5 is transmitted via the spline sleeve portion 62*a* to the outer member 62 of the one-way clutch 6. Then, the rotation of the outer member 62 is transmitted via the rollers 63 to the inner member 61. The pinion gear 7 integrally rotates with the inner member 61. The pinion gear 7, meshing with the ring gear 11, transmits the rotational force of the starter motor 2 to the ring gear 11. Thus, the engine starts rotating.

The engine, after it began rotating, drives the pinion gear 7 via the ring gear 11. Upon the rotational speed of the inner member 61 exceeding the rotational speed of the outer member 62, each roller 63 moves toward a widened side in the cam chamber against the resilient force of the spring. With this movement, the rollers 63 are disengaged from the outer member 62 and the inner member 61. No rotation is transmitted from the inner member 61 to the outer member 62. In other words, the one-way clutch 6 prevents the armature 21 from overrunning. When the ignition switch is turned off after accomplishing the engine start-up operation, no electric current is supplied to the exciting coil 31 and accordingly the plunger 32 returns to the original or home position. In response to this returning movement of the plunger 32, the movable contact 33 of the magnet switch 3 departs from the stationary contact 34. No electric power is supplied to the armature 21. The lever 9 swings to the opposite direction (i.e., the counterclockwise direction in FIG. 1) about the fulcrum 91 of the lever 9. The one-way clutch 6 retracts along the output shaft 5. The pinion gear 7 is disengaged from the ring gear 11 and finally returns to a rest position.

Furthermore, in the process of the pinion gear 7 meshing with the ring gear 11, a large shock will occur between the pinion gear 7 and the ring gear 11 if the shifting speed of the pinion gear 7 is high. When the torque applied to the driving mechanism of the starter 1 reaches a predetermined level (in other words, when an excessive torque is applied), the second friction plates 83 rotate while causing slip relative to the first friction plates 82 which are stationarily fixed by the central housing 102. The transmitting section 81 rotates correspondingly as it is engaged with the second friction plates 83. The internal gear 42 also rotates as it is engaged with the transmitting section 81. Accordingly, both the autorotation and the revolution of the planetary gears 43 are restricted. This effectively prevents the planetary reduction gear device 4 from being subjected to the large shock occurring when the pinion gear 7 collides with the ring gear 11 in their engaging process. Thus, it becomes possible to prevent the planetary reduction gear device 4 and the ring gear 11 from being broken or damaged.

According to the above-described shock absorbing device 8 of the starter 1, a plurality of first friction plates 82 and the plurality of second friction plates 83 are alternately laminated or stacked in the axial direction. The torque transmittable through the shock absorbing device 8 is large. Thus, it becomes possible to provide the starter 1 having the capability of transmitting a large torque required to start the engine. The size of the shock absorbing device 8 is compact in the radial direction normal to the laminated first and second friction plates. Accordingly, the starter 1 becomes compact and is easily installable into the engine. Furthermore, while the shock absorbing device 8 can transmit a large torque, the constituent parts of the planetary reduction gear device 4 can assure sufficient strength even they are downsized. The overall weight of the shock absorbing device 8 can be reduced.

Furthermore, the transmitting section 81 is provided between the second friction plates 83 and the internal gear 42. The transmitting section 81 supports the second friction plates 83. A large shock occurring when the pinion gear 7 engages with the ring gear 11 can be received by the second friction plates 83 via the transmitting section 81.

The shock absorbing device 8 is provided at the position neighboring the axial end side of the internal gear 42 closer to the pinion gear 7. The shock occurring between the pinion gear 7 and the ring gear 11 can be smoothly transmitted to the second friction plates 83.

Furthermore, the internal gear 42 is provided at the radially inner side of the first cylindrical portion 81*a*. The second friction plates 83 are located at the radially outer side of the second cylindrical portion 81*b*. The outer diameter of the second cylindrical portion 81*b* is smaller than that of the first cylindrical portion 81*a*. The radial difference between the internal gear 42 and the second friction plates 83 is small. Thus, the radial size of the shock absorbing device 8 can be reduced.

Furthermore, the shock absorbing device 8 is located at the radially outer side of the carrier pins 13 and is disposed in the inside space defined by the inner wall of the central housing 102 and the outer cylindrical surface of the planetary reduction gear device 4. Thus, it becomes possible to suppress the axial size of the starter 1.

Furthermore, the end portion 102*a* of the central housing 102 is provided with the grooves (not shown) extending in the axial direction (i.e., in the laminating direction of the first friction plates 82 and the second friction plate 83). The circumferential positions of respective grooves correspond to the positions of the first projections 82*a* of the first friction plates 82. The shock absorbing device 8 can be smoothly assembled by sliding the first friction plates 82 in the axial direction to engage the first projections 82*a* with the grooves of the end portion 102*a*.

Furthermore, the dish spring 84 is supported at its front axial end by the caulking portion 81*c*. The rear axial end of the dish spring 84 is brought into contact with the foremost first friction plate 82. The dish spring 84 resiliently urges the first friction plates 82 and the second friction plates 83 in the axial direction. The torque applied to the first friction plates 82 and the second friction plates 83 can be suppressed to a predetermined level by adequately adjusting the caulking amount of the caulking portion 81*c*. Thus, it becomes possible to prevent the planetary reduction gear device 4 and the ring gear 11 from being broken or damaged.

Furthermore, the shock absorbing device 8 is integrated as a unit by providing the caulking portion 81*c* which supports the dish spring 84 resiliently urging the first friction plates 82 and the second friction plates 83 at the radially outer side of the second cylindrical portion 81*b*.

According to the above-described preferred embodiment, the shock absorbing device 8 is provided at the position neighboring the axial end side of the internal gear 42 closer to the pinion gear 7. However, it is possible to provide the shock absorbing device 8 at a position neighboring the other axial end side of the internal gear 42 closer to the motor 2.

Alternatively, it is possible to provide the shock absorbing device 8 at the radially outer side.

Figure 8:
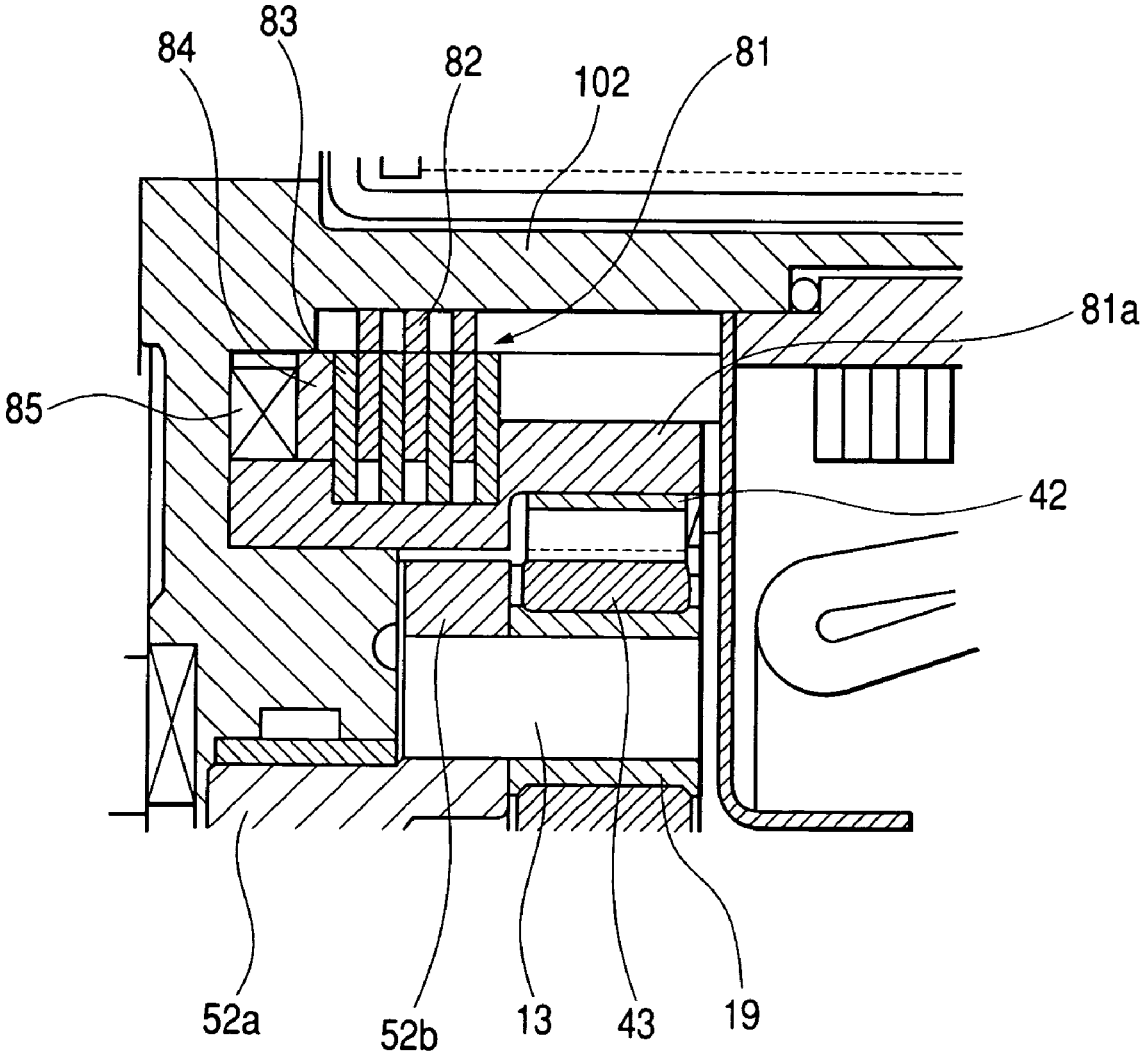
FIG. 8 is a cross-sectional view showing the arrangement of a shock absorbing device in accordance with another preferred embodiment of the present invention.

Furthermore, according to the above-described preferred embodiment, the dish spring 84 of the shock absorbing device 8 is supported by the caulking portion 81*c* of the transmitting section 81. However, it is possible to replace the calking portion 81*c* with a screwed nut 85 for supporting the dish spring 84 as shown in FIG. 8.

Figure 9:
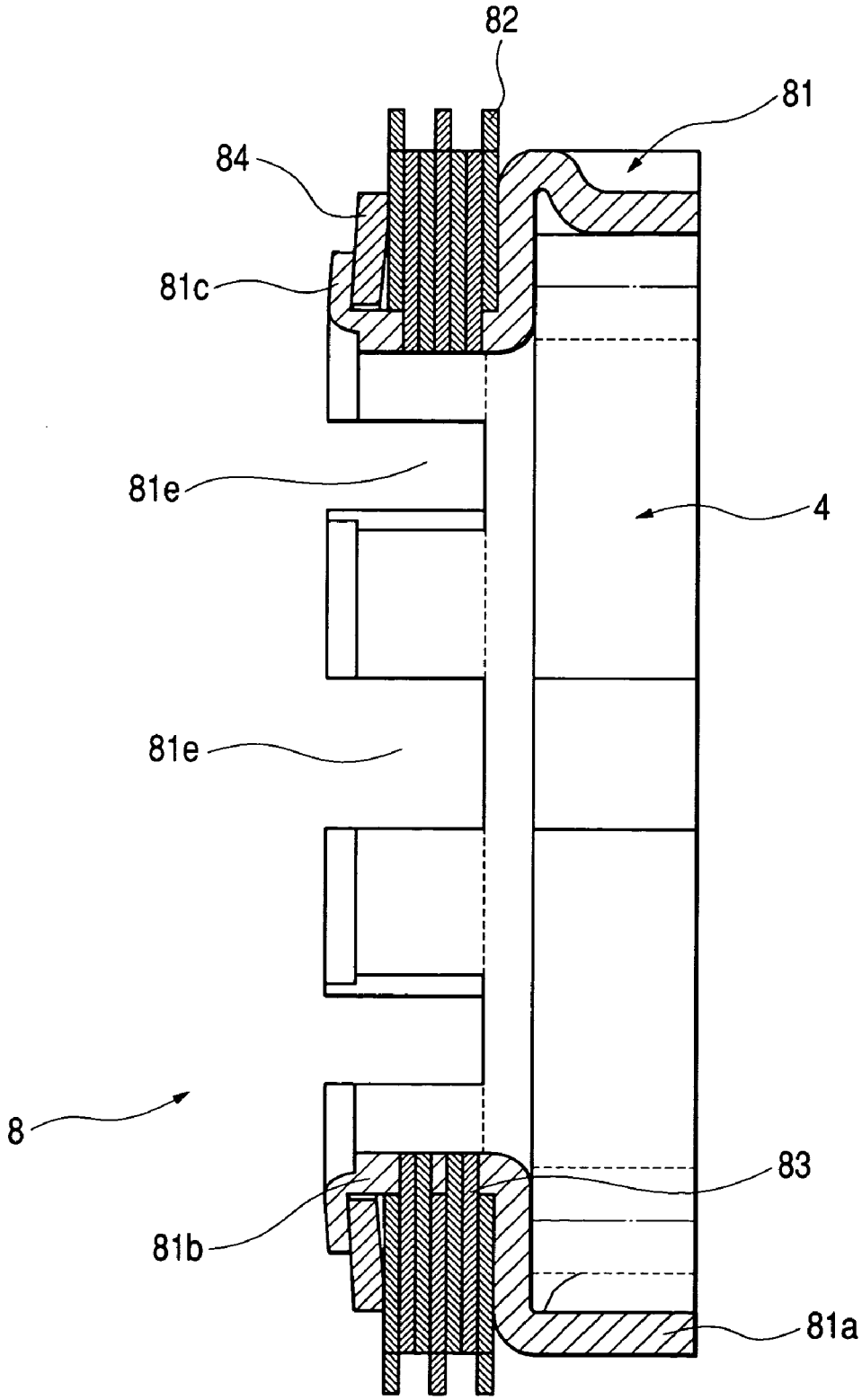
FIG. 9 is a cross-sectional view showing the arrangement of a shock absorbing device in accordance with another preferred embodiment of the present invention.

Moreover, according to the above-described preferred embodiment, the first friction plates 82 and the second friction plates 83 are alternately laminated or stacked in the axial direction as shown in FIG. 3. However, it is possible to change the lamination order of the first friction plates 82 and the second friction plates 83 as shown in FIG. 9, according to which two second friction plates 83 are consecutively placed between two first friction plates 82.

What is claimed is:

1. A starter comprising:

a starter motor driven in response to supply of electric power for generating a rotational force transmitted to an armature;

a planetary reduction gear device for reducing a rotational speed of said armature, said planetary reduction gear device comprising a sun gear provided on a rotary shaft of said armature, planetary gears meshing with said sun gear, and an internal gear meshing with said planetary gears;

an output shaft, supported by a housing, said output shaft is connected to said armature via said planetary reduction gear device for outputting a reduced rotation of said armature;

a pinion gear provided on said output shaft for selectively meshing with a ring gear of an engine; and a shock absorbing device comprising a plurality of first friction plates all of which are provided stationarily relative to each other and to said housing and a plurality of second friction plates, all of which are provided stationarily relative to each other and to said internal gear, and receiving a torque transmitted from said internal gear, said shock absorbing device further comprising a transmitting section interposed between said second friction plates and said internal gear, said shock absorbing device is positioned next to said internal gear, wherein said plurality of first and second friction plates are laminated with each other so as to be brought into frictional engagement when said first friction plates and said second friction plates are pressed by pressing means, thereby obtaining a predetermined frictional torque, and wherein said first friction plates are engaged with an engaging portion of said housing, and said engaging portion of said housing extends in a direction along which said first and second friction plates are laminated to each other.

2. The starter in accordance with claim 1, wherein one end of said output shaft is configured into a flange portion for supporting said planetary reduction gear device, and said shock absorbing device is disposed in a radially extending space defined between said flange portion and said housing accommodating said flange portion.

3. The starter in accordance with claim 1, wherein said transmitting section comprises a first cylindrical portion engaged with an outer cylindrical surface of said internal gear and a second cylindrical portion engaged with an inner cylindrical portion of said second friction plates, and a diameter of said second cylindrical portion is smaller than a diameter of said first cylindrical portion.

4. The starter in accordance with claim 3, wherein said second cylindrical portion has a pressing portion, made by bending a front end of said second cylindrical portion, for forcedly fixing and engaging said pressing means.

* * * * *